United States Patent [19]

Engle

[11] Patent Number: 4,555,102

[45] Date of Patent: Nov. 26, 1985

[54] APPARATUS FOR SEPARATING STACKS OF CLOTH

[75] Inventor: Elbert Engle, Ashville, Ala.

[73] Assignee: Chesebrough-Pond's, Inc., Greenwich, Conn.

[21] Appl. No.: 492,721

[22] Filed: May 11, 1983

[51] Int. Cl.[4] ..... B65H 5/22

[52] U.S. Cl. ..... 271/4; 271/10; 271/18.3; 271/110; 271/155; 271/213; 271/263; 271/294

[58] Field of Search ..... 271/10, 18.3, 94, 110, 271/120, 152–155, 213, 263, 294, 3, 4

[56] References Cited

U.S. PATENT DOCUMENTS

| | | | |
|---|---|---|---|
| 2,896,944 | 7/1959 | Shiba | 271/259 X |
| 2,947,917 | 8/1960 | O'Brien | 317/149 |
| 2,973,202 | 2/1961 | Schmeck et al. | 271/259 |
| 3,253,824 | 5/1966 | Southwell et al. | 271/19 |
| 3,406,961 | 10/1968 | Walton | 271/10 |
| 3,765,672 | 10/1973 | Conner | 271/10 |
| 3,841,623 | 10/1974 | McCarthy et al. | 271/126 |
| 4,049,257 | 9/1977 | Frystak | 271/114 |
| 4,052,050 | 10/1977 | Carter | 271/18.3 |
| 4,121,716 | 10/1978 | Luperti | 209/564 |
| 4,127,266 | 11/1978 | Williams | 271/263 |
| 4,157,825 | 6/1979 | Ellenberger et al. | 271/10 |
| 4,203,590 | 5/1980 | Blessing | 271/265 |
| 4,283,047 | 8/1981 | Blessing | 271/10 |
| 4,348,018 | 9/1982 | Bijttebier et al. | 271/10 |
| 4,437,655 | 3/1984 | Bijttebier | 271/18.3 X |

FOREIGN PATENT DOCUMENTS 2739653 2/1977 Fed. Rep. of Germany .

*Primary Examiner*—Richard A. Schacher

*Attorney, Agent, or Firm*—Brumbaugh, Graves, Donohue & Raymond

[57] ABSTRACT

A machine for separating single plies of fabric from a stack of fabric plies uses a roller provided with a fabric ply engaging mechanism. The roller engages the top ply of fabric and removes it with a rolling action. The engaging mechanism comprises a pivotable rod mounted on the roller and provided with protruding pins which engage the top ply of fabric from the stack as the rod is pivoted. The machine can be arranged to sort alternate plies of fabric from one stack into separate stacks. The machine can be provided with an adjustable support for holding the stack and with a detector for detecting the presence of a single fabric ply on the roller.

92 Claims, 18 Drawing Figures

STEP 5

STEP 6

STEP 7

STEP 8

STEP 1

STEP 2

STEP 3

STEP 4

APPARATUS FOR SEPARATING STACKS OF CLOTH

BACKGROUND OF THE INVENTION

This invention relates to clothing manufacturing and particularly to apparatus for automatically handling fabric.

Most clothing manufacturing is currently carried out using a large amount of manual labor. Prior attempts to automate clothing manufacturing have encountered difficulties with respect to handling single plies of cloth in the process of removing them from a stack of cloth having multiple plies. In one particular operation involving the manufacture of children's garments, such as striped T-shirts using knitted striped fabric, it becomes necessary to separate alternate layers of fabric plies from a stack of fabric plies. Knitted goods used in the manufacture of children's clothing are generally knitted in the form of a large diameter tube. When laid flat for cutting, this tube has two plies which have corresponding patterns, such as stripes, which run around the circumference of the knitted tube. In using such fabric tubes, a cutter cuts a pattern from a stack consisting of many plies of fabric tubes laid flat. The result is a stack of fabric plies which includes alternating layers corresponding to the fronts and backs of a garment. The general outline of the plies in the stack for the front pieces and the back pieces is identical. Since they are cut together from a tube, the front and back pieces match each other in the cloth pattern. The complete shaping of the garment, however, generally requires that the front pieces of the garment be cut at the neck to form a slightly different pattern. In order to cut the front pieces at the neck, it becomes necessary to separate alternating layers in a stack of fabric, and form two stacks corresponding to matching front and back pieces. The stacks which will form front pieces are cut again at the neck line. The corresponding fronts and backs are then combined in a sewing operation from the matching stacks so that the pattern of the knit material will match at the sides. This process of separating the front and back pieces from alternating layers of a stack of fabric plies has heretofore been done by hand, and requires considerable labor cost.

It is therefore an object of the present invention to provide apparatus which automatically handles single plies of cloth contained in a stack of fabric plies.

It is a further object of the present invention to provide an apparatus for detecting the presence of a single ply of material on a fabric transport apparatus.

It is a further object of the present invention to provide apparatus from maintaining the level of a stack of fabric plies in a material handling apparatus.

It is a still further object of the present invention to provide an apparatus for automatically sorting alternate layers of fabric plies contained in a stack of fabric plies and form two stacks therefrom.

SUMMARY OF THE INVENTION

In accordance with the present invention, there is provided an apparatus for removing a single ply of fabric from a stack of fabric plies. The apparatus includes a fabric ply transport mechanism arranged for relative motion with respect to the stack and arranged to engage the top fabric ply of the stack. There is also provided a fabric engaging mechanism mounted on and carried by the transport mechanism. The fabric engaging mechanism comprises an elongated rod mounted to the transport mechanism and pivotable with respect thereto about a longitudinal axis. It includes pins mounted to the rod and extending therefrom in a direction transverse to the rod axis. There are further provided means, interconnecting the rod and the transport mechanism for pivoting the rod about its axis to rotate the pins from a first orientation substantially perpendicular to the top of the stack when the transport mechanism engages the top of the stack, to a second orientation substantially parallel to the top of the stack, whereby the engaging mechanism engages the top fabric ply of the stack.

In a preferred embodiment, the elongated rod has at least two substantially flat surfaces intersecting each other and forming a longitudinal edge, and the pins extends from one of the flat surfaces. The rod engages the stack by the pin containing surface in the first orientation, and engages the stack by the other surface in the second orientation. Preferably the pins extends from the surface in close proximity to the edge and the rod axis is also in close proximity to the edge. The second surface may be provided with openings through when which gas may be emitted for a selected period following rotation of the engaging mechanism, thereby to push away the second fabric ply during the engagement process. The pins preferably extend from the rod by a distance which is less than the thickness of the fabric ply, preferably between about one-half the thickness and less than the full thickness.

In one embodiment, the transport mechanism comprises a roller arranged for rolling engagement motion over the stack of fabric plies and having an outer roller surface provided with a longitudinal opening. The elongated rod which engages the fabric is mounted in the longitudinal opening of the roller. The apparatus may include surfaces for holding the stack from which fabric plies are being removed and for adjusting the height of the stack as plies are removed from the stack. The entire operation of the apparatus may be controlled and coordinated by a control mechanism, which in a preferred embodiment comprises a programmed microprocessor.

In accordance with the invention, there is provided an apparatus for detecting the presence of a fabric on a fabric transport mechanism which has a fabric supporting surface. The apparatus includes a magnetic field source and a magnetic field detector. The transport mechanism is arranged to move fabric between the magnetic field source and the magnetic field detector. Means are provided and coupled to the operation of the transport mechanism, for sampling the output of the magnetic field detector at a selected time during the operation, and for comparing the output to a threshold level thereby to detect the presence of a fabric. Preferably, the threshold level is between the output level of the magnetic field detector when there is no fabric on the transport mechanism and the output of the magnetic field detector when there is a single ply on the transport mechanism. There may also be provided a second threshold level which corresponds to a level between the output level of the detector corresponding to a single fabric ply and the output level corresponding to multiple fabric plies.

In accordance with the invention, there is provided apparatus, useable in a machine for operating on plies of fabric in a stack of fabric plies, wherein there is provided a fabric transport mechanism supported on a machine frame and periodically engaging the top of the stack. The apparatus is for adjusting the position of the stack with respect to the transport mechanism and includes a support for a stack which is mounted to the machine frame for vertical motion with respect to the transport mechanism. There is also provided a source of controlled fluid pressure and a cylinder connected to the fluid pressure source having a piston operated on by the fluid pressure. Means are provided interconnecting the cylinder, the piston, the support and the frame for urging the support in an upward direction with respect to the transport mechanism in response to the fluid pressure on the piston. There is also provided a controlled brake, arranged to prevent movement of the support with respect to the transport when engaged, and to permit movement of the support when disengaged. Control means are provided for operation in coordination with the transport mechanism for disengaging the brake when the transport mechanism engages the top of the stack and for engaging the brake when the transport mechanism is disengaged from the stack.

In accordance with the invention there is provided an apparatus for separating alternate plies from a first stack of fabric plies into second and third separate stacks. The apparatus includes a frame and a first support mounted to the frame and having a first horizontal support platform for holding the first stack of fabric plies. The first support is arranged for vertical movement with respect to the frame. There is also provided a second support mounted to the frame and having second and third vertically separated horizontal support platforms for holding the second and third stacks of fabric, the second support being arranged for vertical movement with respect to the frame. First and second adjustment means are provided for adjusting the level of the first platform with respect to the frame and for adjusting the level of the second and third platforms with respect to the frame. There is provided a carriage on the frame for horizontal motion between positions corresponding to the first and second supports. A roller is provided, carried by the carriage and arranged for rotation with respect thereto in response to motion of said carriage at an angular rotation speed corresponding to approximately zero horizontal motion of the bottom sector of the roller. Engagement means are carried by the roller for engaging a top ply of fabric from the first stack. First transport means are provided for periodically moving the carriage horizontally back and forth across the frame. Second transport means are provided for moving the second support between a first vertical position wherein the carriage and the roller passes over the second support platform and a second vertical position wherein the carriage and the roller passes over the third support platform. Control means are provided for coordinating the operation of the first transport means, the second transport means and the engagement means to cause the engagement means to engage a first ply from the first stack, transport the first ply on the roller, and disengage the first ply on the second stack with the second support in the first position, and to engage a second ply from the first stack, transport the second ply on the roller, and disengage the second ply on the third stack with the second support in the second position.

For a better understanding of the present invention, together with other a further objects, reference is made to the following description, taken in conjunction with the accompanying drawings, and its scope will be pointed out in the appended claims.

DESCRIPTION OF THE INVENTION

Figure 1:
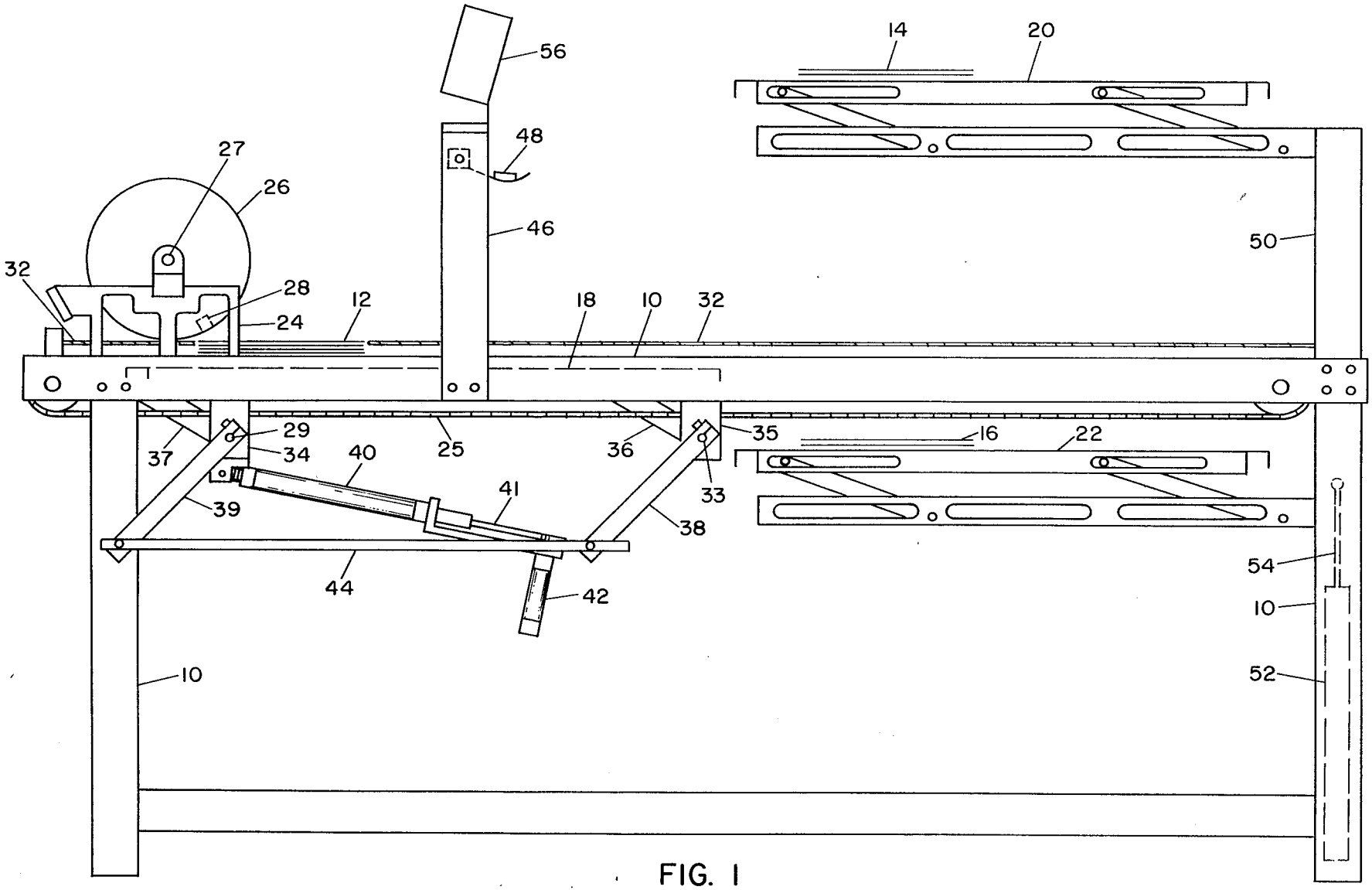
FIG. 1 is a side view of an apparatus in accordance with the present invention.
Figure 2:
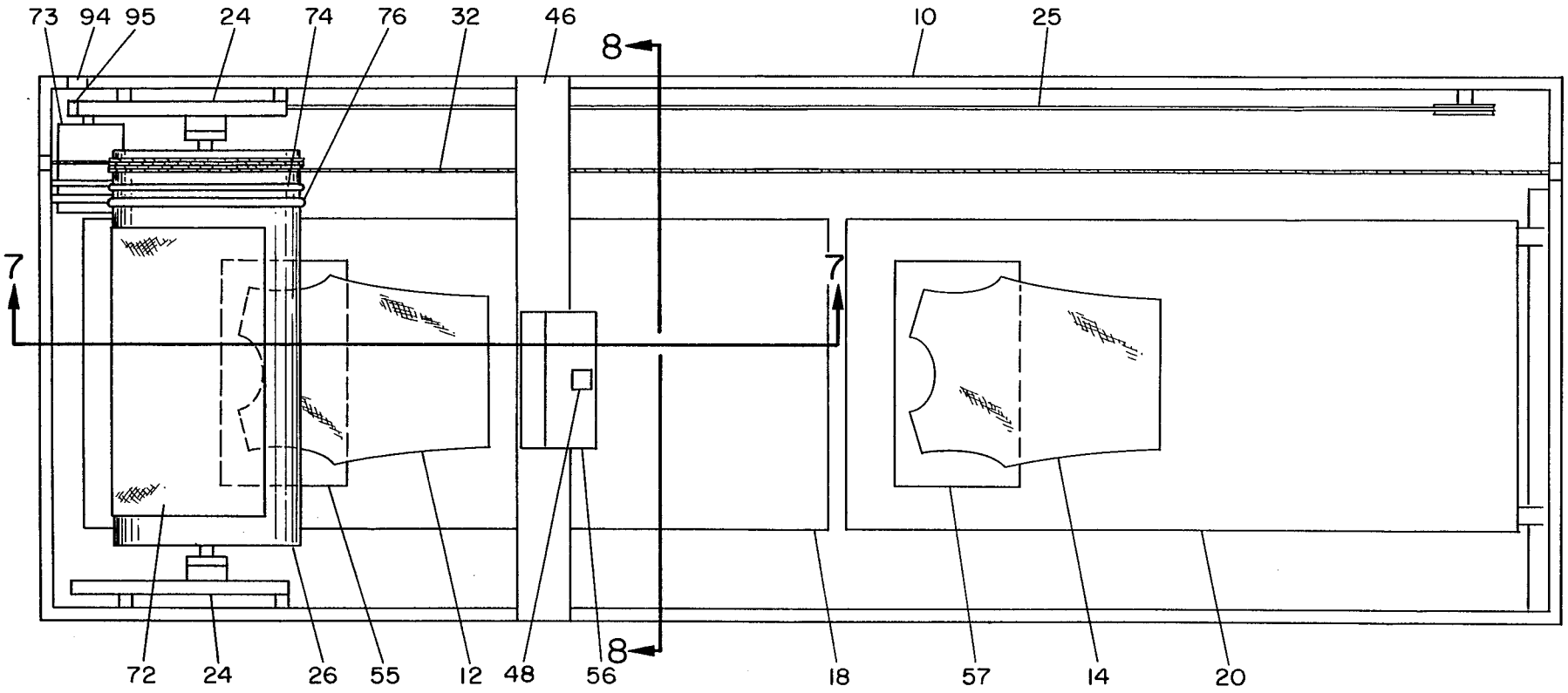
FIG. 2 is a top view of the FIG. 1 apparatus.

Referring generally to FIGS. 1 and 2 there is shown an apparatus in accordance with the present invention for separating single plies of fabric from a stack of fabric plies 12 and sorting alternate layers of fabric into second and third stacks of fabrics 14 and 16. The machine includes a frame 10, which includes horizontal and vertical members in the configuration of an open-top table. The first stack of fabric plies 12 rests on a first support platform 18, which in connection with other members forms a first support. The first support is arranged for vertical motion with respect to frame 10. The second and third stacks of fabric 14 and 16 are respectfully held on second and third support platforms 20 and 22, which are mounted to a second support 50. Support 50 is arranged for vertical motion with respect to frame 10. Second support 50 operates as an elevator moving up and down to present support platforms 20 and 22 alternately to receive plies of fabric.

As shown in FIG. 2, platforms 18, 20 and 22 are provided with foam rubber cushions about a half-inch thick covering the portion of the platform supporting about half the stacks 12, 14 and 16. Visible in FIG. 2 are foam cushions 55 and 57 on platforms 18 and 20, respectively.

A carriage 24 is mounted to frame 10 in a fixed position in the vertical direction. Carriage 24 is arranged to move horizontally across the top member of the frame 10 in a back-and-forth motion to the left and right as shown in FIGS. 1 and 2 under the influence of a transport mechanism which includes a driving chain 25 driven by stepper motor 73. Carriage 24 includes a roller 26 pivotally mounted on an axis 27 to the frame of carriage 24. Roller 26 is provided with a cable 32 which wraps around the roller 26, frictionally engaging the roller. Cable 32 has its ends securely fastened to frame 10. Accordingly, as roller 26 is carried back and forth by carriage 24 when driven by chain 25, the roller rolls across the top of the fabric stacks 12, 14 and 16 in a manner whereby the bottom portion of the roller has no net horizontal movement during the rolling. Accordingly, a rolling engagement takes place.

Roller 26 is provided with a fabric engaging means 28 designed to engage the top ply of fabric from stack 12 in order to draw the fabric around roller 26 and thereby transport the fabric onto stack 14 or 16 depending on the position of second support member 50.

Figure 7:
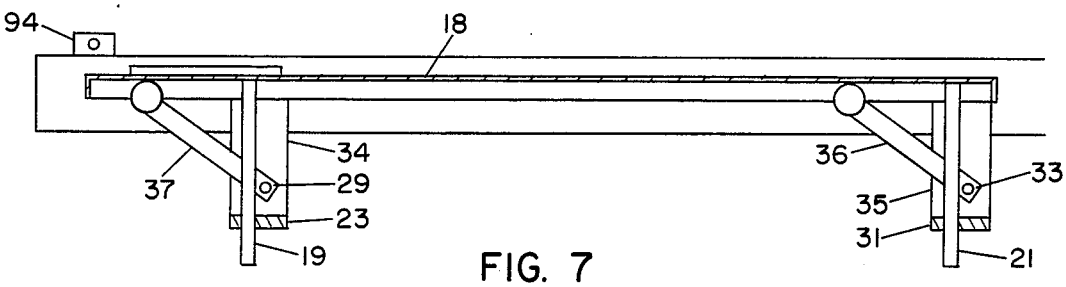
FIG. 7 is a partial longitudinal cross-section of the apparatus of FIGS. 1 and 2.
Figure 8:
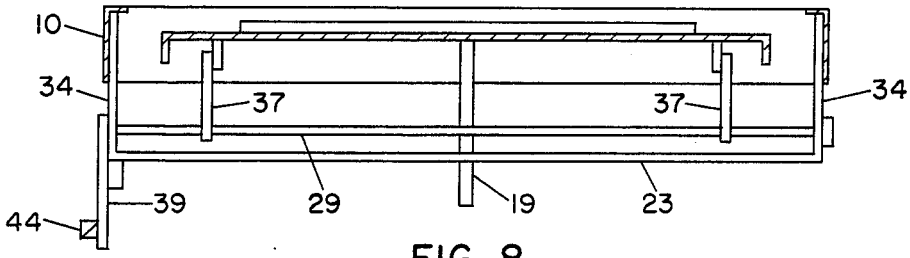
FIG. 8 is a transverse cross-section of the apparatus of FIGS. 1 and 2.
Figure 9A:
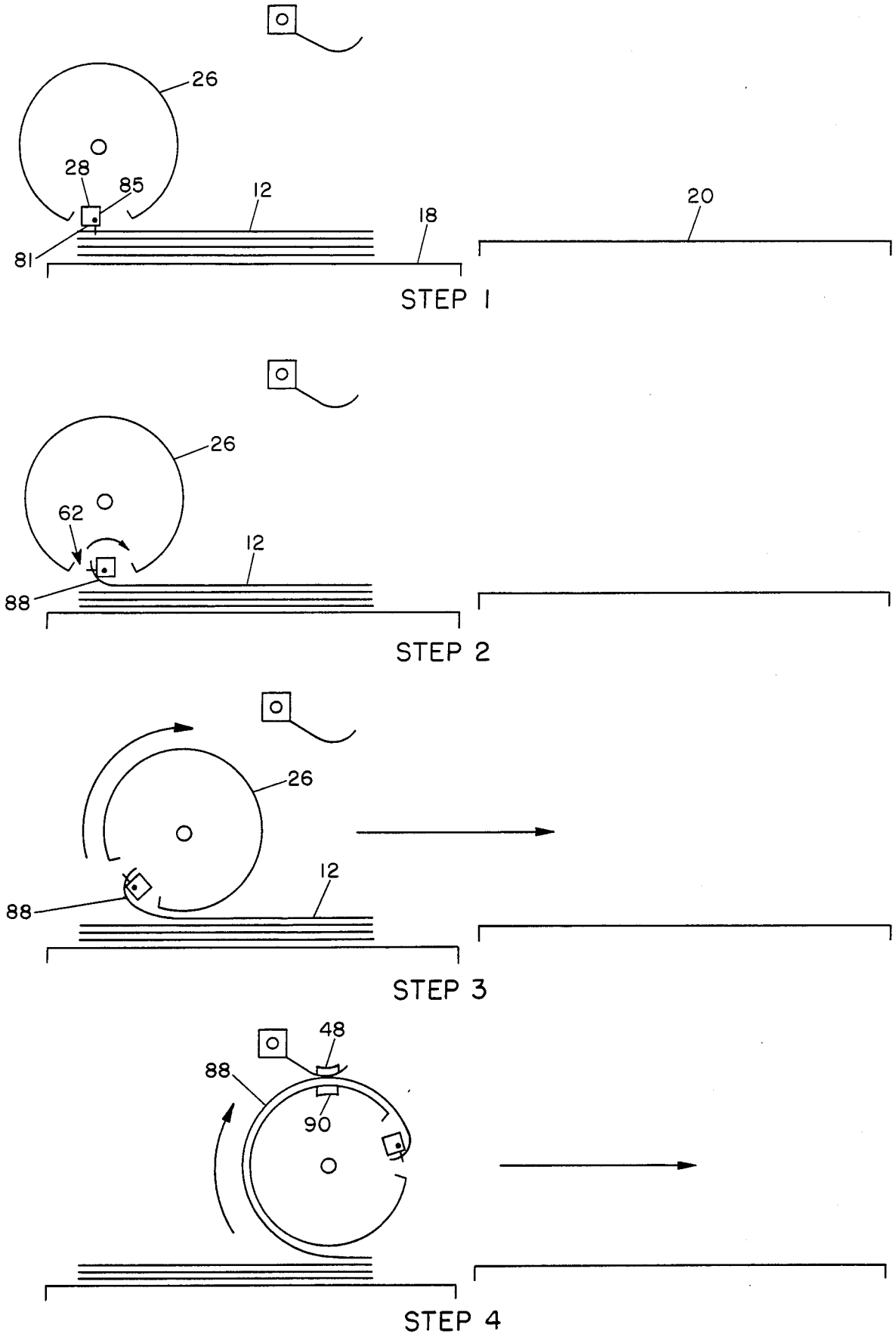
FIGS. 9A and 9B are simplified diagrams illustrating the operation of the FIG. 1 apparatus.
Figure 9B:
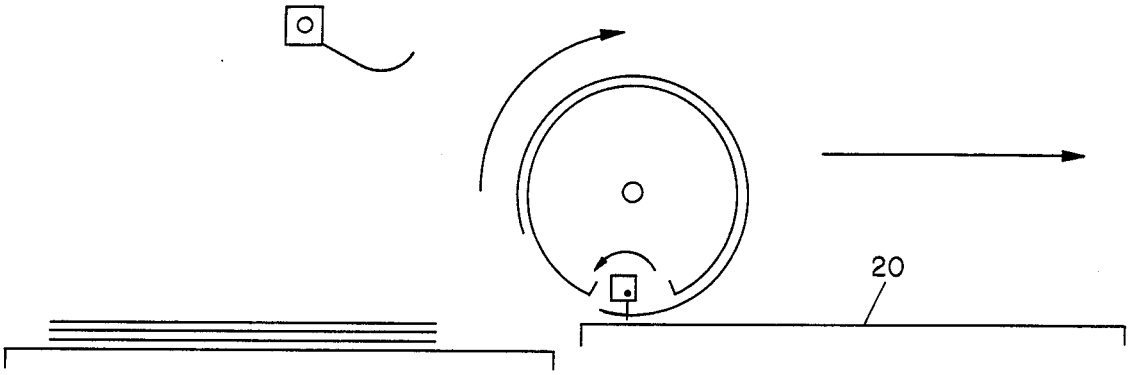
Figure 9B:
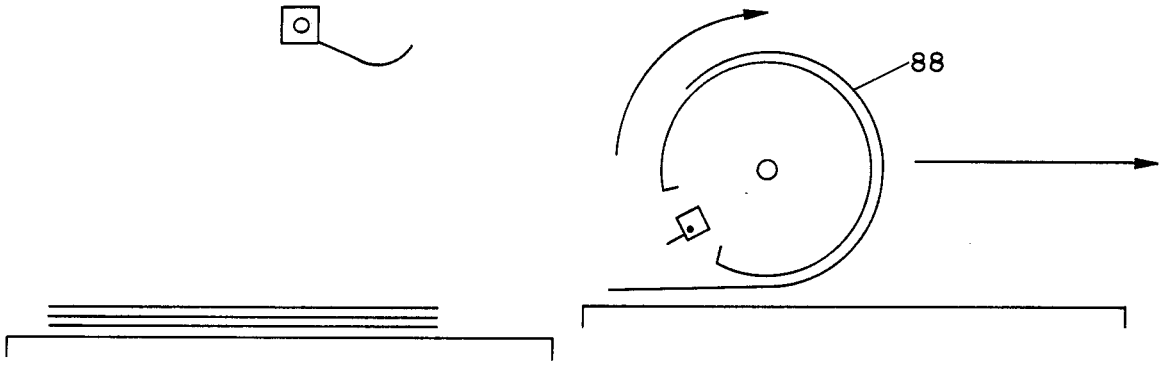
Figure 9B:
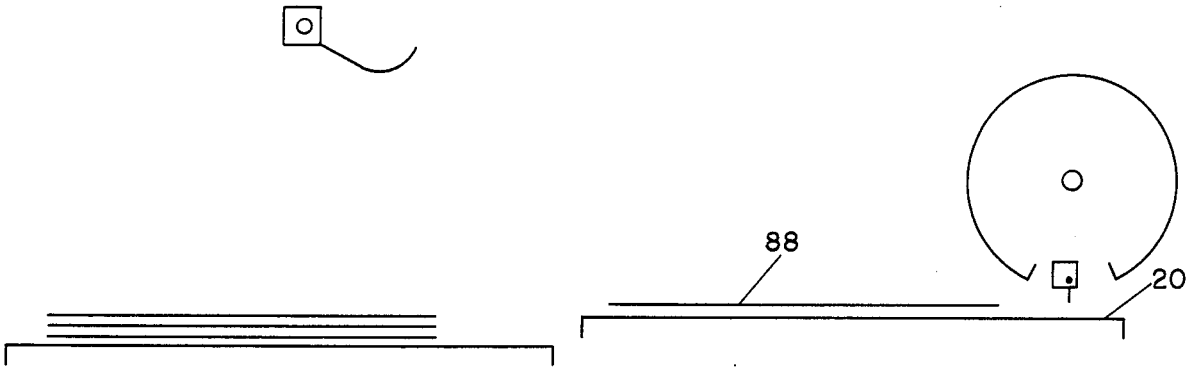
Figure 9B:
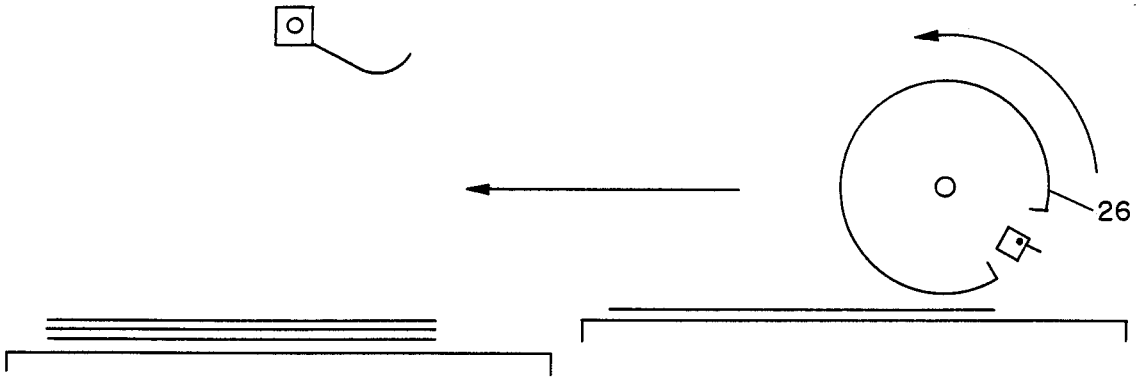
Figure 10A:
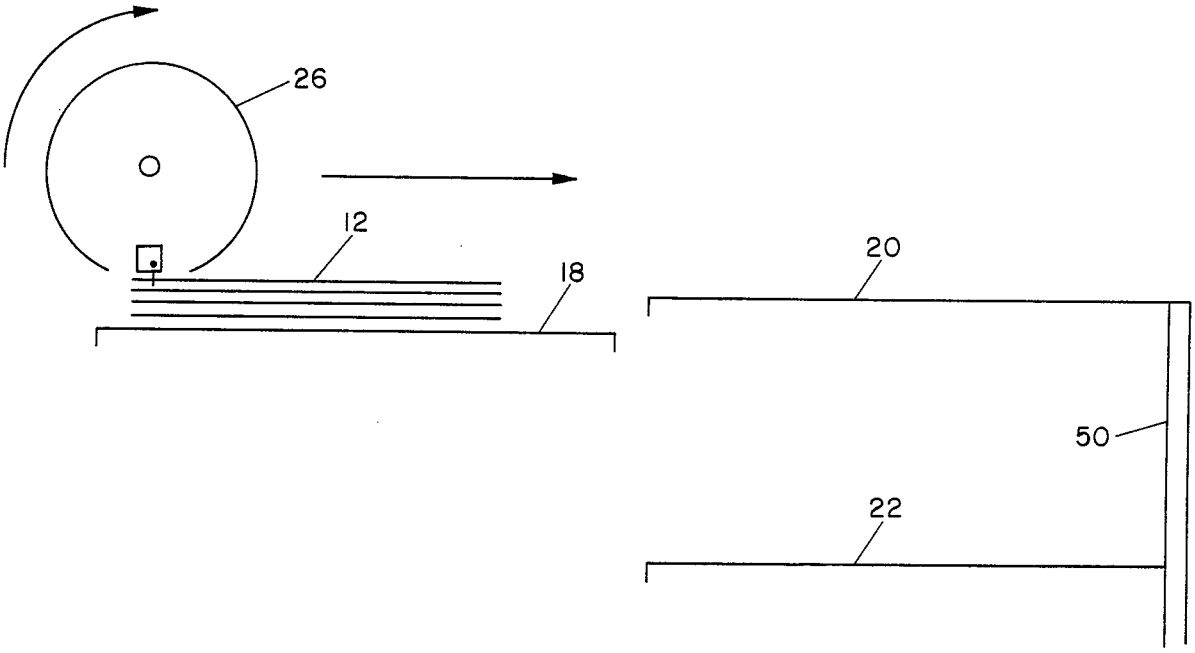
FIGS. 10A and 10B are simplified diagrams illustrating the operation of the FIG. 1 apparatus.
Figure 10A:
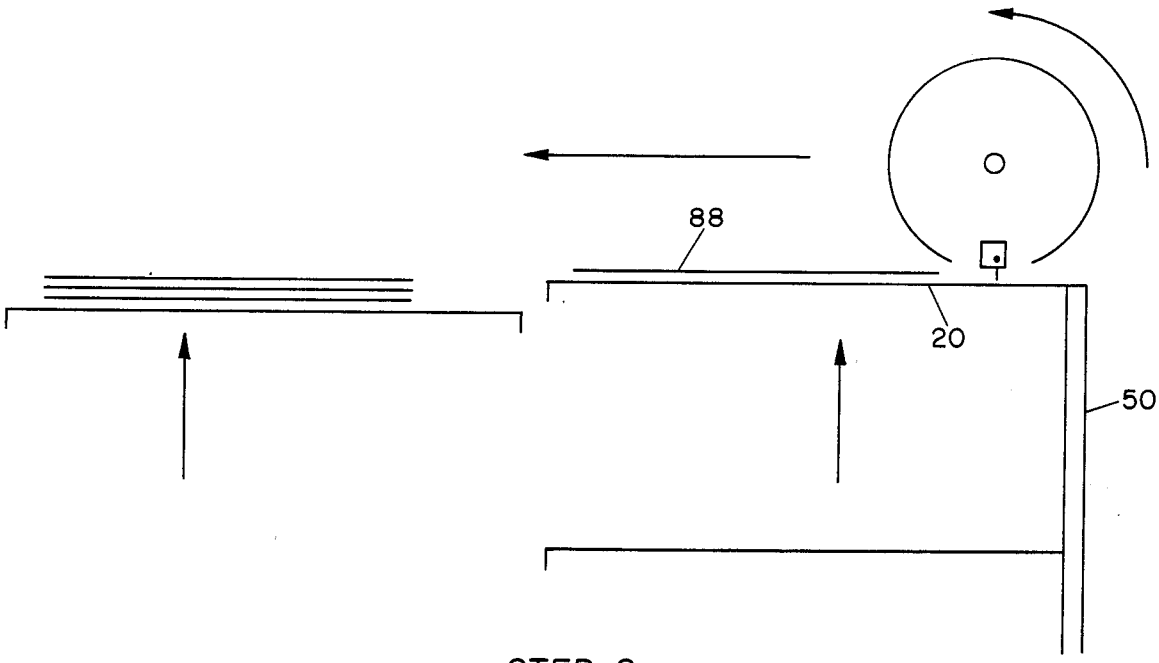
Figure 10B:
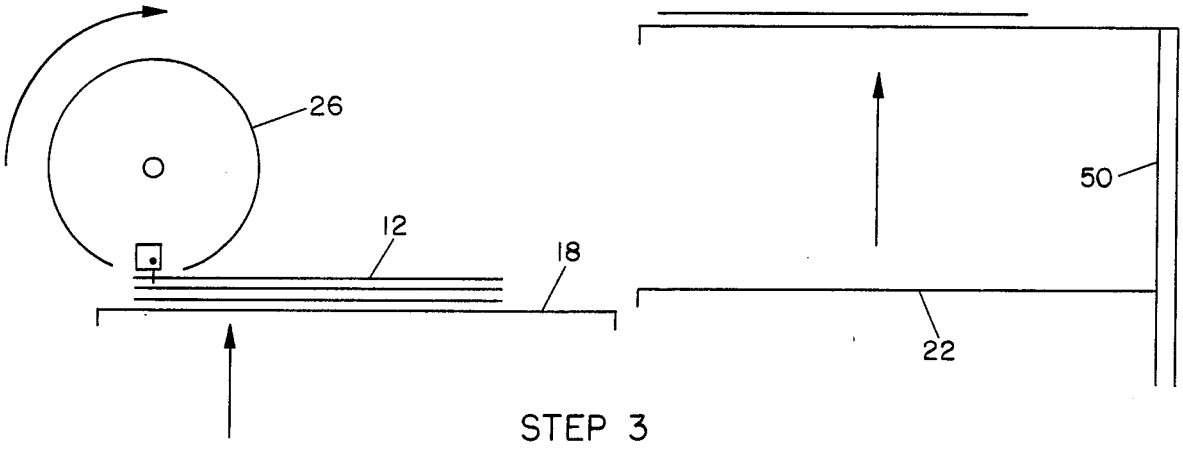
Figure 10B:
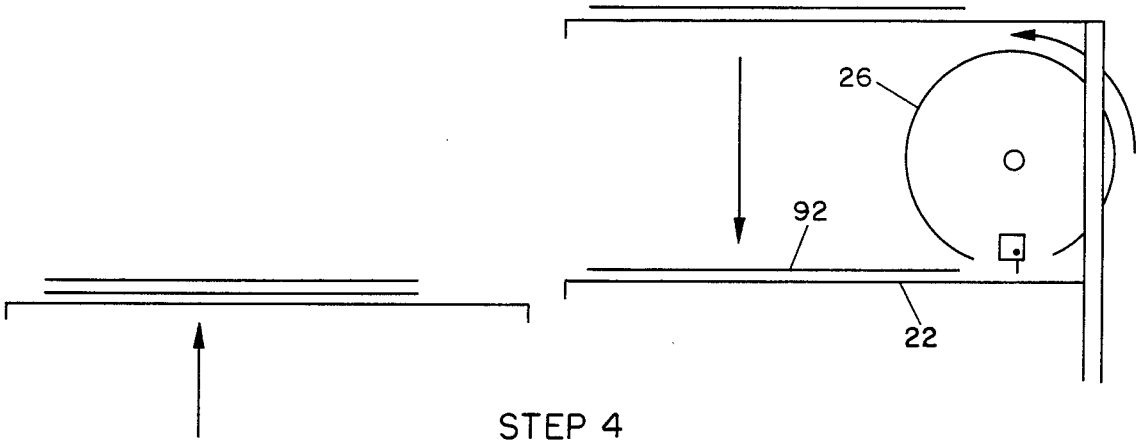
Figure 11:
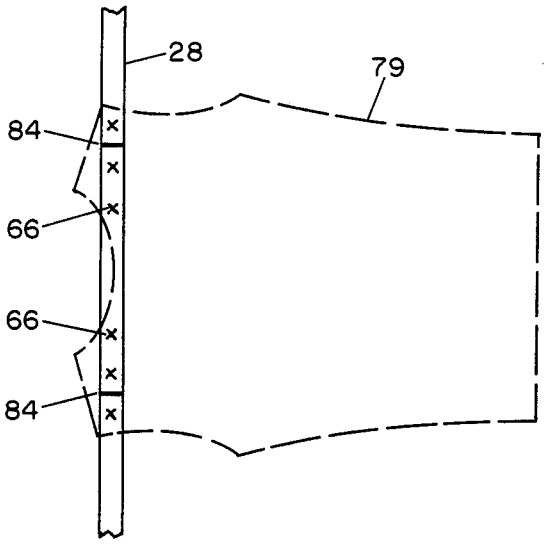
FIG. 11 is a sketch showing the engagement position for the engagement means of the FIG. 1 apparatus.

Frame members 34 and 35 are mounted to the horizontal portion of frame 10 and thereby support first support platform 18. Greater detail concerning the support of platform 18 can be seen in the drawings of FIGS. 7 and 8, which are vertical cross-section views of the support arrangement. Platform 18 is provided with rods 19 and 21 which pass through horizontal portions 23 and 31 connected to vertical members 34 and 35. Lever arms 36 and 37 are connected to respective axle members 33 and 29. Levers 36 and 37 are provided with roller members at their upper end which engage the underside of platform 18 and support platform 18 in the vertical direction. Axle members 29 and 33 are connected to levers 39 and 38, as illustrated in FIG. 1. Levers 38 and 39 are connected together with tie rod 44 and driven by cylinder 40. Cylinder 40 is supplied with air pressure which urges piston 41 in an inward direction with respect to the cylinder, thereby providing upward pressure on platform 18 through levers 38, 39, 36, and 37. Cylinder 40 is supplied with fluid pressure, such as compressed air, having a controlled amount of pressure to provide a selected amount of upward force on platform 18, for example, in the neighborhood of 5 to 10 pounds upward force. A brake member 42, which is, for example, a compressed air operated brake, is provided to prevent, when engaged, movement of piston 41 under the influence of the supplied air pressure and thereby to lock platform 18 in a fixed position with respect to frame 10.

When roller 26 is in a position which engages fabric stack 12, brake 42 is disengaged and air pressure supplied to cylinder 40 draws piston 41 into cylinder 40, and thereby presses stack 12 upwardly against roller 26. As roller 26 moves out of disengagement with stack 12, brake 42 is engaged so that platform 18 and stack 12 are maintained in a fixed position with respect to frame 10 and consequently a fixed position with respect to roller 26. Similar apparatus for adjusting the levels of platforms 20 and 22 with respect to support member 50 are also provided.

Figure 12:
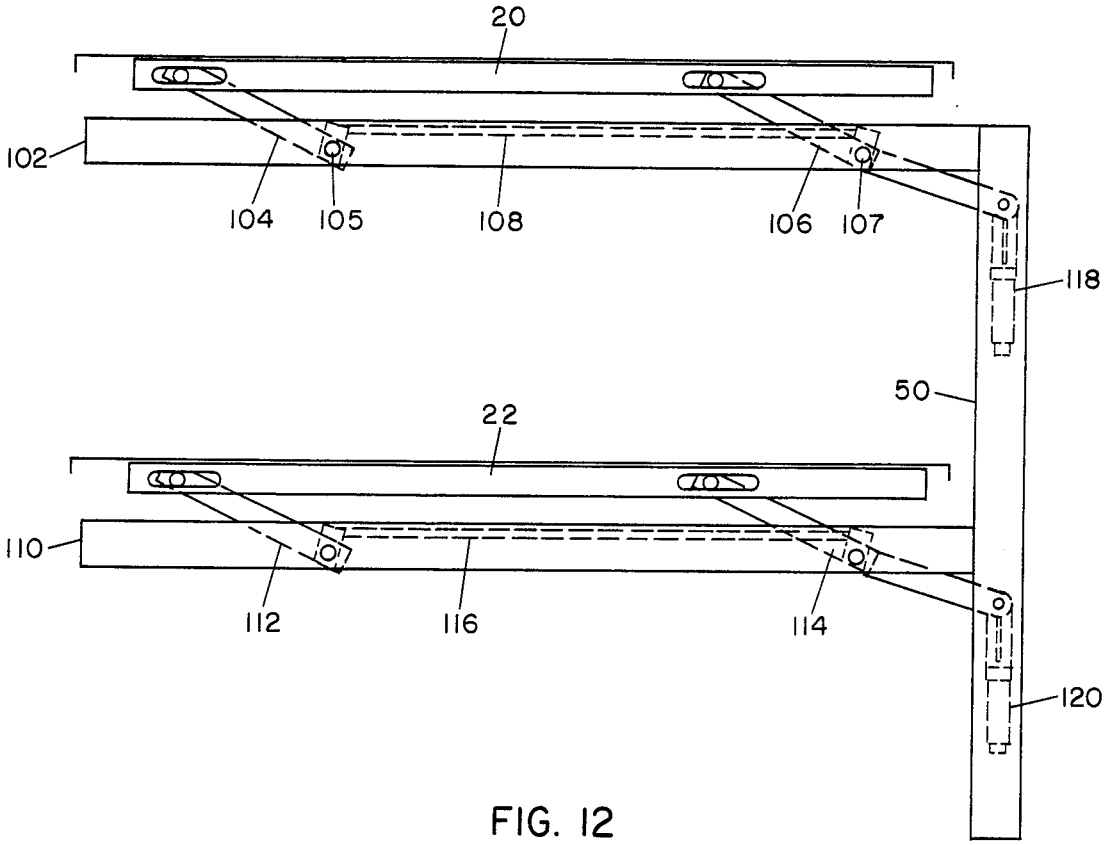
FIG. 12 is a side view of a support adjusting mechansim used in the FIG. 1 apparatus.
Figure 13:
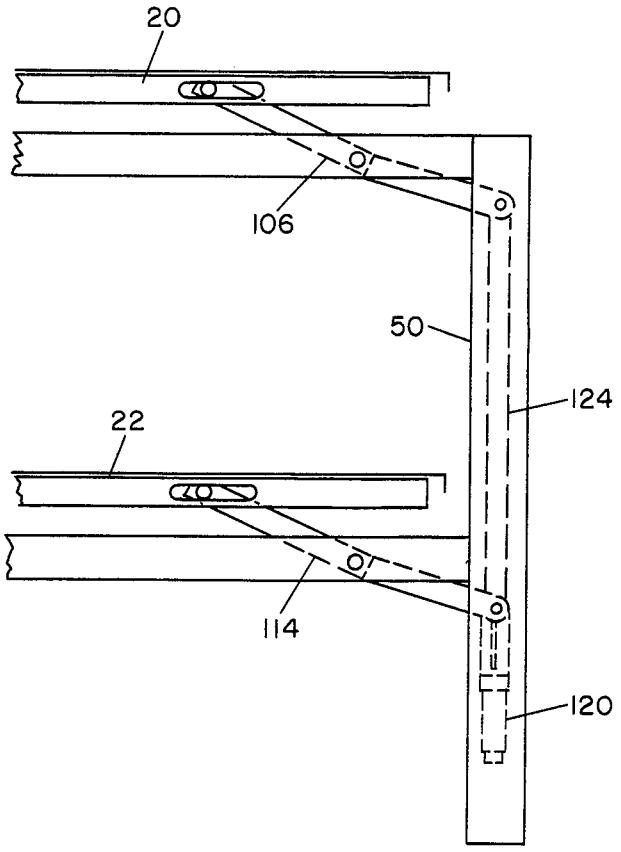
FIG. 13 is a side view of an alternate support adjusting mechanism used in the FIG. 1 apparatus.
Figure 14:
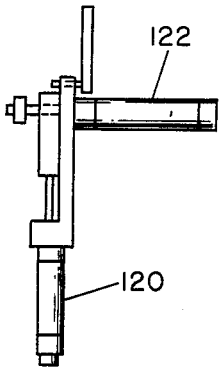
FIG. 14 is an end view of an adjusting cylinder used in the FIG. 13 apparatus.

FIG. 12 shows the details of an adjusting mechanism useable in connection with support platforms 20 and 22 on support 50. Platforms 20 and 22 may be provided with vertical support rods, similar to rods 19 and 21, which permit vertical, but not horizontal, motion with respect to horizontal support members 102 and 110. Vertical support for platform 20 is provided by levers 104 and 106, which are rigidly connected to respective axles 105 and 107. A tie rod 108 connects axles 105 and 107 for uniform rotational motion with respect to support 102. One end of lever 106 is connected to an adjusting piston 118. The arrangement of levers 112, 114, connecting rod 116 and adjusting piston 120 which support platform 22 is similar. FIG. 14 is an end view of cylinder 120, which illustrates its connection to a brake 122. Piston 118 is provided with a similar brake. Pistons 118 and 120, in connection with their associated lever mechanism act to adjust the levers of platforms 20 and 22 when the corresponding brakes are disengaged. The operation is similar to the adjusting mechanism for support platform 18. Thus piston 118 is operative when roller 26 engages a stack on plaftorm 20 and pistion 120 is operative when roller 26 engages a stack on platform 22. Since platforms 20 and 22 are receiving plies of fabric, roller 20 forces the platforms down against the supplied, controlled air pressure to achieve a gradual downward adjustment of platforms 20 and 22. FIG. 13 is a partial diagram of support 50, which shows an alternate construction wherein a connecting rod 124 is provided to connect the ends of levers 114 and 106, so that piston 120 can operate both levers, and piston 118 and its associated brake are not required.

An air cylinder 52 having a piston 54 is connected between second support 50 and frame 10. Air pressure supplied to cylinder 52, which is preferably a two-way piston, drives support 50 up and down to alternately present platforms 20 and 22 to receive plies of fabric.

Mounted on frame 10 is an additional frame member 46 which supports a microprocessor control unit 56 which controls operation of the apparatus. Frame member 46 also provides support for a resilient and pivotable probe member containing a magnetic field sensor 48.

Figure 3:
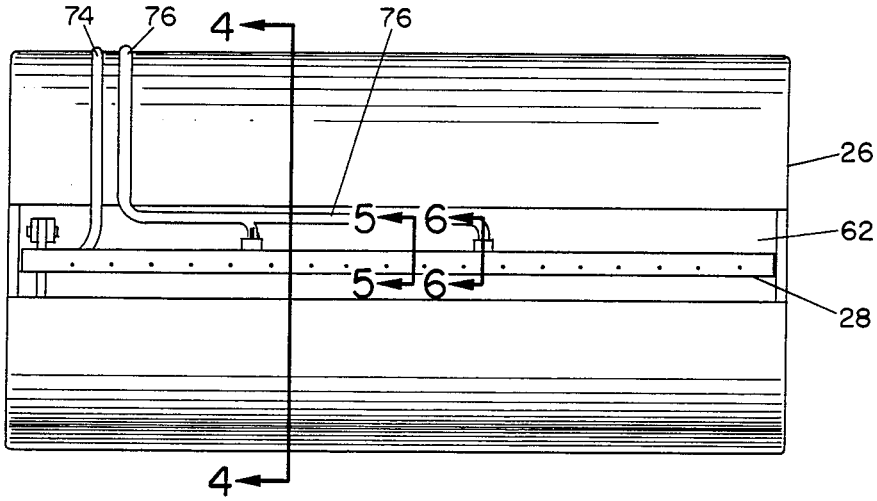
FIG. 3 is a plan view of the roller used in the FIG. 1 apparatus, showing the engagement means.
Figure 5:
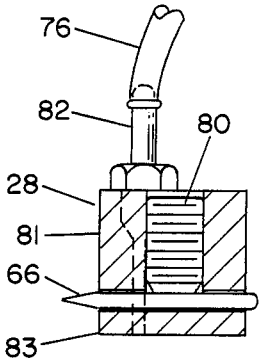
FIG. 5 is a cross-sectional view of the engagement means used in the FIG. 3 roller.
Figure 4:
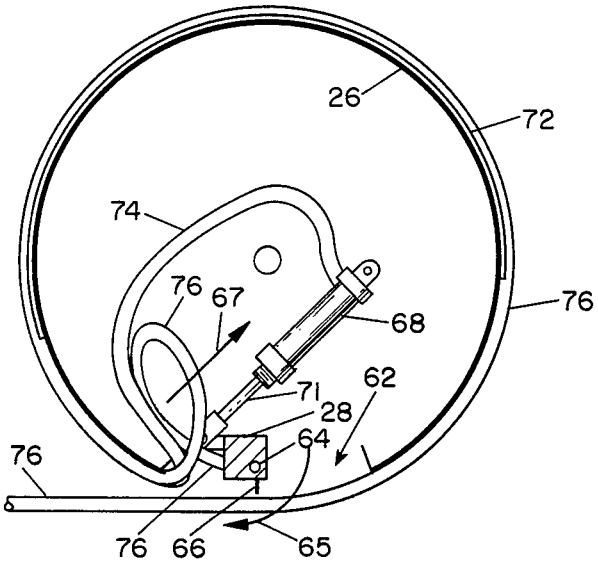
FIG. 4 is a cross-sectional view of the FIG. 3 roller.
Figure 6:
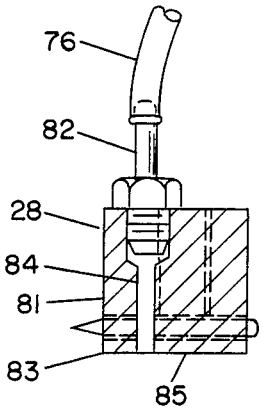
FIG. 6 is another cross-sectional view of the engagement means used in the FIG. 3 roller.

Referring to FIGS. 3 through 6, there are shown further details of the roller 26 which is used in connection with the apparatus of FIG. 1. FIG. 3 is an exterior view of roller 26, showing engaging mechanism 28 which is arranged to engage an end of the top ply of fabric on stack 12. Cross sectional details are shown in FIGS. 4–6. Roller 26 is a hollow cylindrical roller fabricated with an outer roller surface formed of sheet metal. Roller 26 has an opening 62 in the outer roller surface which accommodates fabric engaging mechanism 28. Opening 62 is approximately $2\frac{1}{4}$ inches wide in the direction of the circumference of roller 26. Roller 26 is approximately 9 inches in diameter. Engaging mechanism 28 includes a square cross-section elongated rod, which is pivotable about an axis 64 (FIG. 4) which is in the direction of elongation of the rod and parallel to the axis of cylinder 26. Flat surface 81 of rod 28 is provided with a plurality of pins 66, which protrude from the surface by a distance which is less than the thickness of the cloth which is to be engaged. Preferably the protrusion of pins 66 is in the range of about one-half of the cloth thickness to less than the thickness of the cloth.

Pivot axis 64 of rod 28 is located in the vicinity of the intersection of two flat surfaces 81 and 85 of the rod, which form a right angle edge 83 near pins 66. In one embodiment the axis is approximately $\frac{1}{8}$ inch from surfaces 81 and 85, and pins 66 are located on surface 81 a distance of $\frac{1}{8}$ inch from edge 83. In this case rod 28 is $\frac{1}{2}$ inch square in cross-section.

Roller 26 is provided with an operating mechanism comprising an air cylinder 68 (FIG. 4) which operates under the influence of air or other gas pressure provided over tube 74, which wraps around the periphery of cylinder 26 as it moves along frame 10. When air pressure is provided to cylinder 68, it draws piston rod 71 in the direction indicated by arrow 67, thereby rotating elongated rod 28 in the direction shown by arrow 65. This operation rotates the elongated rod 28 by approximately 90° from a first orientation shown in FIG. 4 to a second orientation, and causes the pins 66 to firmly engage an end of the top ply of the fabric to be drawn onto the roller 26.

FIGS. 4 and 5 are cross-sectional views showing greater details of the elongated rod 28. FIG. 4 shows pins 66, which protrude from the rod by a small amount, usually in the range of 0.025 to 0.030 inches. Pins 66 in one embodiment comprise commercial type B-27 sewing needles. The pins are held to rod 28 by set screws 80. When rod 28 is in a first orientation shown in FIG. 4, pins 66 face radially outward with respect to roller axis 27. Pins 66 approximately intersect the pivoting axis 64 of rod 28.

Rod 28 is also provided with air openings 84, shown in FIG. 6, which are connected by coupling 82 to air supply line 76. Air openings 84 have outlets on second flat surface 85 of rod 28. Surface 85 is the surface which is radially outward from the axis of roller 26 when operating mechanism 68 rotates rod 28 to the second orientation about axis 64. Accordingly, when rod 28 is rotated to the second orientation to engage a fabric ply, air openings 84 and surface 85 face toward the stack of fabric. At this point, an air jet may be supplied over line 76 to blow through the engaged first ply and help separate it from the second and further plies of fabric as roller 26 starts to move with the first ply of fabric engaged by pins 66. FIG. 10 shows in dotted outline a piece of fabric 79 to be engaged, and also shows the elongated rod 28 having six pins 66 (shown as X) to engage fabric 78. The apparatus is preferably arranged as shown in FIG. 10 wherein there are provided three pins 66 which engage each side of one end of the fabric ply 79. There are supplied air openings 84 adjacent each set of three pins where they engage the fabric. The fabric is arranged on platform 18 at a position wherein pins 66 engage the ply about ½ inch from the end of the fabric. It should be recognized that the fabric engaging arrangement illustrated in FIG. 10 is a typical arrangement for one particular pattern of fabric 78, and other arrangements of pins 66 or air openings 84 may be appropriate for different fabric shapes. Likewise, it should be recognized that the extension of pins 66 outward from the flat surface 81 from which they emerge can be adjusted by the use of set screws 80 to correspond to the thickness of the fabric to be engaged.

FIG. 9 is a series of simplified drawings illustrating the operation of the roller 26 and engagement means 28 in picking plies of fabric from a stack 12 on a first support platform 18 and depositing the fabrics onto a second support platform 20. As illustrated in FIG. 1, at step 1, roller 26 is moved near its left-most position wherein it engages the top of the stack 12 of fabric at the end of the stack away from support platform 20. When the roller 26 is placed into this position, the engagement means 28 has the position illustrated, wherein surface 81 from which pins 66 emerge is facing outward with respect to the axis 27 of roller 26, and thereby engages the top ply of fabric on stack 12. Immediately after this engagement with rod 28 in a first orientation, rod 28 is rotated by 90° about its own axis 64, to a second orientation, shown in step 2 of FIG. 9, wherein the pins 66 are oriented circumferentially with respect to the axis of roller 26 and the surface 85 is facing the top ply of fabric stack 12. When this position is reached, the first ply of fabric 88 is engaged on pins 66 and drawn slightly upward at its edge into the opening 62 of roller 26. In step 3, roller 26 has initiated a rolling motion to the right. Starting with the pivoting of engagement rod 28, as illustrated in step 2, and during the initial movement of roller 26 to the right as illustrated in step 3, air is supplied through tube 76 to openings 84 on surface 85 of rod 28. The air thus supplied is blown through fabric ply 88 and serves to keep the remaining fabric plies of stack 12 in a flatened condition, so that they do not cling to first ply 88. As illustrated in step 4, roller 26 continues a rolling motion to the right, and draws the first ply 88 of fabric almost completely around the roller. It will be noted in this step that the circumference of roller 26 is selected to be greater than the length of the fabric ply in the direction of movement of the roller. It should be likewise noted that the circumference of the roller corresponds approximately to the distance between corresponding portions of the first platform 18 and the second platform 20 as will become further evident.

As illustrated in Step 4 of FIG. 9, during the rolling motion to the right, the periphery of roller 26 engages a magnetic field detector 48 which is mounted on a resilient support bearing against roller 26. A permanent magnet 90 is positioned on the periphery of roller 26 at an angular and longitudinal position so that it passes directly beneath magnetic field sensor 48. When the roller reaches this position, the output level of magnetic field sensor 48 is sampled and compared to a threshold level, or a plurality of threshold levels. This sampling is to determine whether the roller has engaged a single ply of fabric 88, has failed to engage a fabric, or has engaged multiple plies of fabric.

In a preferred embodiment, the output level of magnetic field detector 48 is compared to upper and lower threshold levels. The upper threshold level is selected to correspond to a magnetic field which is less than the magnetic field when there is no material on roller 26, and greater than the magentic field when there is a single ply of material on roller 26. The second threshold level is selected to correspond to a magnetic field which is less than that experienced when there is a single ply but greater than that experienced when there are multiple plies of material on roller 26. Accordingly by sampling the output level of magnetic field detector 48, when the magnetic field source 90 is in a position opposite the magnetic field detector, it is possible to determine whether there is no cloth on roller 26, more than one layer of cloth on roller 26 or a correct condition of a single layer of cloth on roller 26.

In a preferred embodiment, the output level of magnetic field detector 48 is supplied as an analog magnetic field proportional signal to an analog-to-digital converter. The sampled signal, converted to digital format, is supplied to a microprocessor, wherein the sampled value is compared to upper and lower threshold values to determine whether the appropriate single ply of material has been engaged by the roller. In the event of a malfunction, which results in either no material on the roller or a multiple ply of material on the roller, the microprocessor is arranged to discontinue operation of the transport mechanism until an operator can manually reset the machine. The use of a microprocessor in connection with the sampling operation is preferable, since it is possible to adjust both the upper and lower threshold values, according to the thickness of the material being picked up by the roller.

Step 5 of FIG. 9 shows a further progress of roller 26 to the right at the condition wherein the roller 26 has completed one full revolution. At this point, rod 28 is pivoted from its second orientation back to its first orientation, whereby the pins are again oriented radially outward with respect to the axis of roller 26 so that the ply of material on the roller starts to unroll from the roller to be deposited onto supporting platform 20. Step 6 shows further action as the material is unrolled from roller 26. As illustrated in FIGS. 2 and 4, roller 26 is preferably provided with a cloth covering 72 which covers the outer periphery of roller 26 over approximately half its circumference on the side opposite to the opening 62 containing rod 28. This cloth covering is advantageous in the position shown in step 6 of FIG. 9 because it provides a high friction surface which prevents the ply of material 88 from sliding off the roller at this position, and thereby possibly becoming poorly deposited onto surface 20.

Step 7 of FIG. 9 shows the end of the rightward movement of roller 26 when the ply of material 88 has been completely deposited on receiving platform 20. At this point, the movement of the carriage 24 and roller 26 is reversed to return to the starting position with the rod 28 in the disengaged position with surface 81 facing radially outward with respect to the axis of roller 26.

Referring to FIG. 1, it should be noted that the apparatus illustrated is provided with second and third supporting platforms 20 and 22 which are arranged to receive alternate layers of material from stack 12 to form stacks 14 and 16. The operation of the device in this respect makes use of cylinder 52 which has piston rod 54 engaging vertical support 50 which is connected in supporting relationship to second and third platforms 20 and 22. FIG. 10 is a simplified diagram illustrating the operation of the apparatus of FIG. 1 to form second and third stacks 14 and 16 on platforms 20 and 22. In this regard, the apparatus operates similar to the operation illustrated in FIG. 9, with additional operation provided by piston 52 to move support member 50 up and down to form the two stacks. In step 1 of FIG. 10, the roller 26 engages the top ply from stack 12 as it begins its motion to the right. As shown in step 2 of FIG. 9, roller 26 has completed its motion to the right depositing a single ply 88 of the fabric onto platform 20 to start the formation of stack 14. In step 3 of FIG. 9, roller 26 is beginning a second half of its operating cycle and engaging the second ply of stack 12. Meanwhile, support member 50 has moved upward in a vertical direcion in order to align support platform 22 with the path of roller 26. As shown in step 4 of FIG. 9, roller 26 has deposited the second ply of material 92 onto support platform 22 in order to initiate a formation of the third stack 16.

It should be noted that during the back and forth motion of roller 26, there may be provided an adjustment of the height of platform 18 while the roller engages stack 12 and adjustment of the height of platforms 20 and 22 while the roller 26 engages stacks 14 and 16 on these platforms.

As previously mentioned, the apparatus of the present invention may be advantageously controlled in order to coordinate its various operations through the use of a programmed microprocessor contained in control unit 56. In this respect, the microprocessor routine may be initiated by a position signal which corresponds to the left-most position of carriage 24 carrying roller 26. This left most position can be detected by the use of a magnetic field sensing unit 94, shown in FIG. 2, which senses a magnetic field source 95 carried by carriage 24. The sensing of carriage 24 by sensor 94 can initiate a cycle to operate stepper motor 73 to drive carriage 24 by chain 26; to operate piston 52; to operate the brakes 42, 122 on pistons 40, 118,120; to sample magnetic field sensor 48; to supply air to operate the operating piston 68 within roller 26 and to supply air to openings 84 in rod 28.

Starting from the left most position of carriage 24 with roller 26, which is sensed by magnetic field sensor 94 mounted on frame 10, the microprocessor provides a control signal to rotate elongated rod 28 from a first orientation with surface 81 facing radially outward with respect to the axis of roller 26 to a second orientation wherein surface 85 faces radially outward. At the same time microprocessor 56 provides a control signal which operates a valve to start an air flow through conduit 76 providing an air jet through openings 84. The provision of air through openings 84 will continue for a selected time after the initiation of movement of roller 26 to the right following rotation of rod 28, for example, during the first 20 to 45 degrees of rotation of roller 26. Roller 26 starts moving to the right immediately following the rotation of bar 28. In one embodiment, the roller moves under the control of a stepper motor 73 connected to drive chain 25 so that the motion of roller 26 with carriage 24 is precisely controlled by the microprocessor. After a selected amount of movement the supply of air through conduit 76 to openings 84 is discontinued. After a further time, when the roller has reached a position shown as step 4 in FIG. 9, the microprocessor provides a control signal to sample the output of magnetic field sensor 48. By operating on the sampled output, the microprocesor decides whether roller 26 has properly engaged a single ply of material or has improperly engaged either no ply of material or more than one ply of material. In the event of improper operation or if the stack 12 has been completely depleted, the machine is automatically stopped by the microprocessor for further attention by the machine operator.

Assuming correct operation of the machine, engaging a single ply of fabric, the microprocessor continues to move carriage 24 and roller 26 to the right until it reaches the position shown in step 5 of FIG. 9. In this position, the microprocessor provides a signal to pivot rod 28 back to the first orientation to release the end of the fabric ply which is wrapped around the roller. The roller continues its motion to the right until it reaches the far right end of platform 20 and has completely unrolled the single ply of material on the platform 20. The microprocessor then reverses operation of stepper motor 73, returning the roller to the starting position and, after the roller is clear of platform 20 supplies a signal to provide air to cylinder 52 to operate piston rod 54 to raise support 50 to a position where third platform 22 is adjacent the path of carriage 24 and roller 26. When roller 26 and carriage 24 reach the left most position, again sensed by magnetic field detector 94, the microprocessor again starts its motion to the right causing the rod to engage a second layer of fabric, the air jets operates at a proper time and the magnetic field sensing device checks that proper engagement of the second single layer of fabric has occured. The roller 26 moves across the top of frame 10 and over platform 22, which by this time is in the proper position and discharges the second layer of fabric onto the now formed stack 16.

During the time that roller 26 engages the top of stack 12, the microprocessor also supplies a signal to brake 42 to disengage the brake and allow platform 18 to be moved upward on the influence of air pressure supplied to cylinder 40. Likewise, when roller 26 is engaging stack 14 or 16 on platforms 20 and 22, similar adjustment may be provided.

Figure 15A:
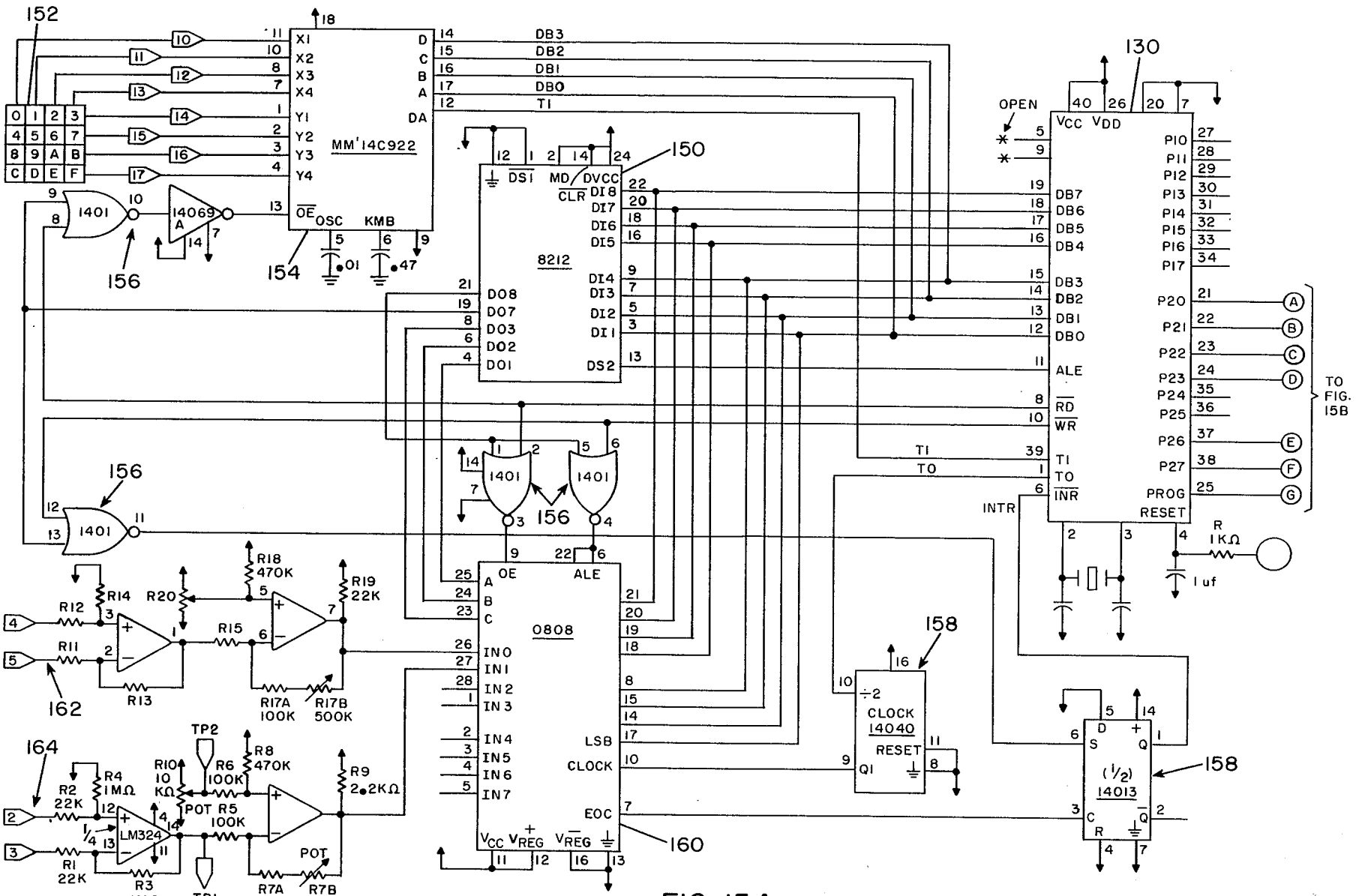
FIGS. 15A and 15B are schematic diagrams of a control circuit for the FIG. 1 apparatus.
Figure 15B:
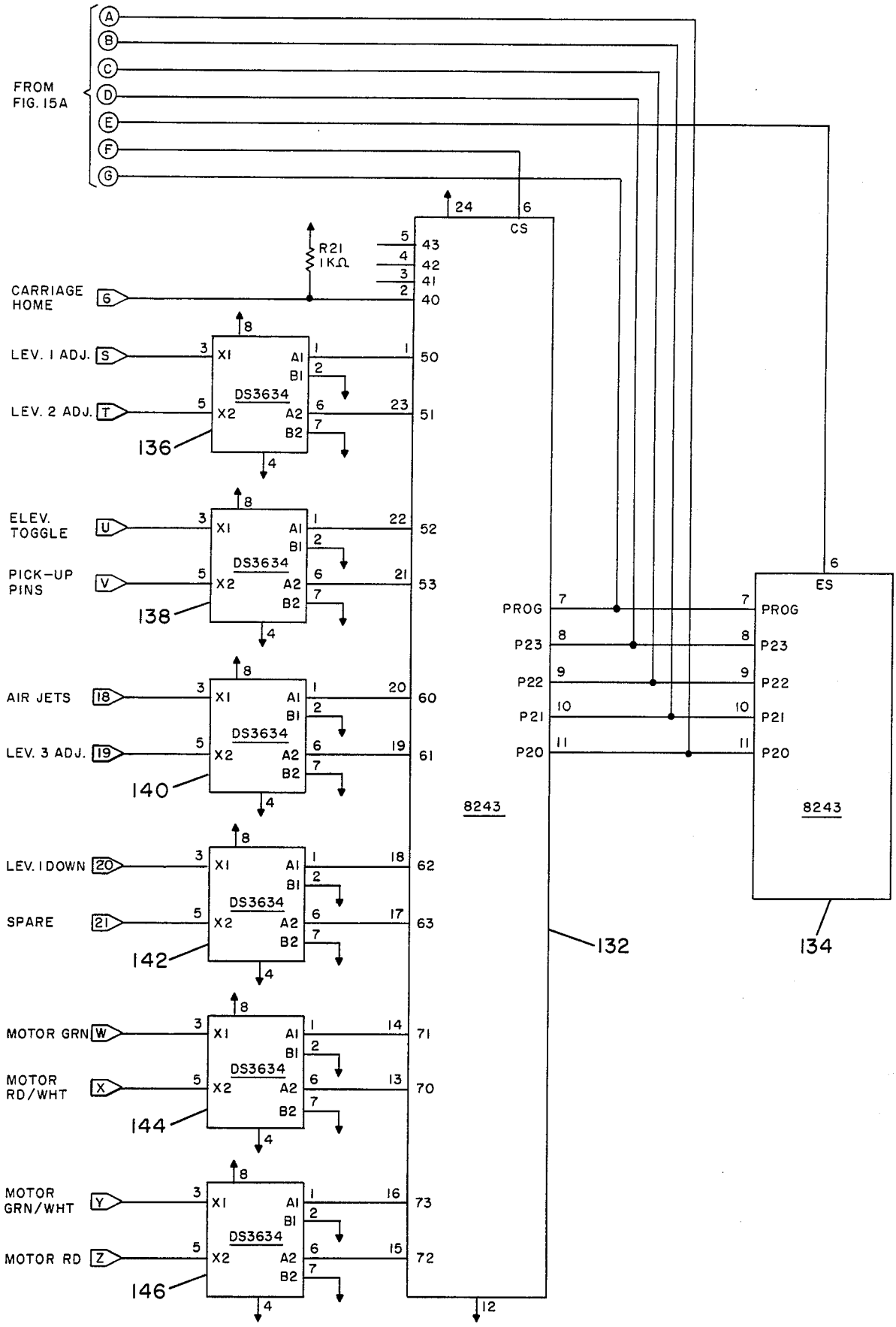

FIG. 15 is a circuit diagram showing the control circuit for operation of the apparatus shown in FIG. 1. The control circuit makes use of a single chip microcomputer 130, which is an Intel MCS-48 microcomputer. The microcomputer 130 is provided with output port expanders 132 and 134 which are Intel integrated circuits type 8243. Output part expander 134 is not used in the arrangement shown. Output port expander 132 has output terminals connected to output buffers 136, 138, 140, 142, 144 and 146. These output buffers provides signals to the various operating components of the system. For example, output buffer 140 provides outputs which operate solonoid valves to supply air to air jets 84 on engagement rod 28. The other output of buffer 140 operates the adjustment mechanism for the third support platform 24, for example, by operating a pneumatic controlled valve which supplies compressed air to brake 122. The additional outputs of the remaining buffers 136, 138 and 142 perform similar functions, including an initial downward motion of platforms 18 for the purpose of loading the platform, adjustment of platforms 18 and 20, operation of piston 52 and operating piston 68. Output buffers 144 and 146 supply pulse signals to control the operation of stepper motor 73. Output port expander 132 has an additional output from pin 40 which provides an indication that carriage 24 is in its home position with magnetic field source 95 adjacent magnetic field sensor 94.

Microcomputer 130 is also provided with an output buffer 150 comprising integrated circuit type 8212, which is used to hold output commands for the magnetic field sampling operation. Gates 156 and flip-flops 158 also aid in this control function. Also provided is an analog-to-digital converter 160, integrated circuit type 0808, which has addressable inputs. This integrated circuit is connected to input amplifiers 162 and 164, which sample the magnetic field sensed by detectors 48 and 94. Control of the microprocessor, for example, to adjust the range of thickness corresponding to a single fabric ply or to lower platform 18 for initial loading, is effected by the use of key pad 152, which is connected to input buffer 154.

Filed with this application is a microfiche appendix which sets forth a suitable microprocessor control program for use with the MCS-48 microcomputer and the circuit of FIG. 15.

While there has been described what is believed to be the preferred embodiment of the present invention, those skilled in the art will recognized that other and further modifications may be made thereto without departing from the spirit of the invention, and it is intended to claim all such changes and modifications as fall within the true scope of the invention.

I claim:

1. Apparatus for removing a single ply of fabric from a stack of fabric plies, comprising a fabric ply transport mechanism arranged for relative motion with respect to said stack and arranged to engage the top fabric ply of said stack and a fabric engaging mechanism mounted on and carried by said transport mechanism, said fabric engaging mechanism comprising an elongated rod mounted to said transport mechanism, and pivotable with respect thereto about a longitudinal axis, pins mounted to said rod and extending therefrom in a direction transverse to said axis, means interconnecting said rod and said transport mechanism for pivoting said rod said axis to rotate said pins from a first orientation substantially perpendicular to the top of said stack, when said transport mechanism engages the top of said stack, to a second orientation substantially parallel to the top of said stack, whereby said engaging mechanism engages the top fabric ply of said stack, said rod further including a plurality of openings, said openings facing said stack when said rod is in said second orientation, and wherein there are provided means for emitting a gas from said openings for a selected period following pivoting of said rod from said first to said second orientation.

2. Apparatus as specified in claim 1 wherein said elongated rod has at least two substantially flat surfaces intersecting each other and forming a longitudinal edge, and wherein said pins extend from one of said surfaces and said openings are in the other of said surfaces.

3. Apparatus as specified in claim 2 wherein said rod is arranged to engage said stack by said one pin containing surface in said first orientation, and to engage said stack by said other surface in said second orientation.

4. Apparatus as specified in claim 3 wherein said pins extend from said surface in close proximity to said edge.

5. Apparatus as specified in claim 4 wherein said axis is in close proximity to said edge.

6. Apparatus as specified in claim 1 wherein said pins extend from said rod by a distance which is less than the thickness of said fabric plies.

7. Apparatus as specified in claim 1 wherein said pins extend from said rod by a distance which is at least about one-half the thickness of said fabric plies and less than the thickness of said fabric plies.

8. Apparatus for removing a single ply of fabric from a stack of fabric plies, comprising:

a roller having an axis and arranged for rolling, engaging motion over said stack and having an outer roller surface provided with a longitudinal opening;

an elongated rod, mounted in said opening parallel to the axis of said roller, said rod being pivotable with respect to said roller about a longitudinal rod axis, said rod having pins mounted thereto and extending therefrom in a direction transverse to said rod axis;

and operating means interconnecting said elongated rod and said roller for pivoting said rod about said rod axis to rotate said pins from a first orientation, substantially perpendicular to said roller surface and radial with respect to said roller axis, to a second orientation substantially parallel to said roller surface and circumferential with respect to said roller axis.

9. Apparatus as specified in claim 8 wherein said elongated rod has first and second substantially flat surfaces which meet each other to form a longitudinal edge having an included angle of approximately a right angle and wherein said pins extend from said first surface, said first surface facing radially outward with respect to said roller axis when said rod has said first orientation and said second surface facing radially outward with respect to said roller axis when said rod has said second orientation.

10. Apparatus as specified in claim 9 wherein said second surface is provided with openings, and wherein there are provided means for emitting a gas from said openings following rotation of said rod from said first to said second orientation.

11. Apparatus as specified in claim 9 wherein said pins extend from said surface in close proximity to said edge.

12. Apparatus as specified in claim 11 wherein said axis is in close proximity to said edge.

13. Apparatus as specified in claim 8 wherein said pins extend from said rod by a distance which is less than the thickness of said fabric plies.

14. Apparatus as specified in claim 8 wherein said pins extend from said rod by a distance which is at least about one-half the thickness of said fabric plies and less than the thickness of said fabric plies.

15. Apparatus for removing a single ply of fabric from a stack of fabric plies, comprising:

a first supporting surface for holding said stack;

a second supporting surface for receiving said ply, said second surface being arranged horizontally adjacent said first surface in a first direction;

a roller having an axis arranged for rolling motion over said first and second surface, back-and-forth along said first direction and transverse to said axis, said roller having an outer roller surface provided with a longitudinal opening and being arranged to engage the upper surface of said stack, said longitudinal opening at least partially facing said stack when said roller engages an end of said stack away from said second supporting surface;

an elongated rod mounted in said opening on said roller parallel to said roller axis, said rod being pivotable with respect to said roller about a longitudinal rod axis, said rod having first and second substantially flat surfaces which meet to form a longitudinal edge, said first surface being provided with pins extending outward therefrom;

operating means interconnecting said elongated rod and said roller for pivoting said rod about said rod axis to rotate said rod from a first orientation wherein said first surface faces radially outward from said roller to a second orientation wherein said second surface faces radially outward from said roller;

and control means for coordinating operation of said roller and said operating means, to cause said operating means to rotate said rod from said first orientation to said second orientation when said roller opening faces said end of said stack, thereby to engage a top ply of fabric on said stack, and to rotate said rod from said second orientation to said first orientation when said opening faces downward over said second supporting surface thereby to release said ply.

16. Apparatus as specified in claim 15 wherein said pins are extended from said surface in close proximity to said edge.

17. Apparatus as specified in claim 16 wherein said axis is in close proximity to said edge.

18. Apparatus as specified in claim 15 wherein said other surface is provided with openings, and wherein there are provided means for emitting a gas from said openings for a selected period following rotation of said rod from said first to said second orientation, and wherein said control means coordinates operation of said gas emitting means.

19. Apparatus as specified in claim 15 wherein said pins extend from said rod by a distance which is less than the thickness of said fabric plies.

20. Apparatus as specified in claim 15 wherein said pins extend from said rod by a distance which is at least about one-half the thickness of said fabric plies and less than the thickness of said fabric plies.

21. Apparatus as specified in claim 15 wherein said roller has a circumference which is greater than the length of said fabric plies in said first direction.

22. Apparatus as specified in claim 15 wherein said roller and said rod have axial lengths which are greater than the width of said fabric plies in the direction of said roller axis.

23. Apparatus as specified in claim 15 wherein said roller is provided over at least a portion of said roller surface with high friction surface.

24. Apparatus as specified in claim 23 wherein said high-friction surface comprises a cloth surface.

25. Apparatus as specified in claim 15 wherein said roller is mounted on a carriage and rotatable with respect thereto, and wherein said carriage is arranged for said back and forth motion along said first direction.

26. Apparatus as specified in claim 15 wherein there is provided a frame supporting said first and second surfaces and said roller, and wherein said roller is arranged for said back and forth motion with respect to said frame.

27. Apparatus as specified in claim 26 wherein said first supporting surface is arranged for vertical adjustment with respect to said frame, thereby to maintain said stack at a vertical height to engage said roller.

28. Apparatus as specified in claim 15 wherein there is further provided means engaging said roller during said back and forth motion for detecting the presence of a single ply of fabric on said roller.

29. Apparatus as specified in claim 28 wherein said detecting means includes a magnet and a magnetic field strength detector.

30. Apparatus as specified in claim 29 wherein said magnet comprises permanent magnet mounted on said roller, and wherein said magnetic field detector engages said roller adjacent said magnet during said motion.

31. Apparatus as specified in claim 28 wherein said control means is responsive to said detecting means for discontinuing operation of said roller when said detecting means detects other than a single ply of fabric.

32. Apparatus as specified in claim 15 wherein said control means includes a programmed microprocessor.

33. Apparatus as specified in claim 32 wherein said microprocessor provides a first output signal for controlling the motion of said roller and a second output signal, coordinated with said first output signal for controlling the operation of said operating means.

34. Apparatus as specified in claim 33 wherein said roller includes a stepping motor responsive to said first output signal for providing said motion.

35. Apparatus as specified in claim 33 wherein there is provided means for adjusting the level of said first supporting surface, and wherein said microprocessor provides a third output signal for controlling said surface adjusting means.

36. Apparatus as specified in claim 33 wherein there are provided means for detecting the presence of a single fabric ply on said roller, and wherein said microprocessor responds to said detecting means for discontinuing operation of said roller when other than a single ply is detected.

37. Apparatus as specified in claim 33 wherein there is provided gas emitting means on said elongated rod and wherein said microprocessor provides a fourth output signal controlling operation of said gas emitting means.

38. Apparatus for detecting the presence of fabric on a fabric transport mechanism having a fabric supporting surface, comprising a magnetic field source mounted to form a part of said fabric supporting surface and a magnetic field detector engaging said fabric on said supporting surface, said transport mechanism being arranged to transport fabric between said magnetic field source and said magnetic field detector, and means coupled to the operation of said transport mechanism for sampling the output of said magnetic field detector at a selected time during said operation, and for comparing said output to a threshold level, thereby to detect the presence of a fabric.

39. Apparatus as specified in claim 38 wherein said magnetic field detector has first output levels at said selected time when there is less than a desired number of plies of fabric between said source and said detector and a second output level at said selected time when there is a desired number of plies of fabric between said source and said detector, and wherein said threshold level is between said first and second output levels.

40. Apparatus as specified in claim 39 wherein said desired number of plies is one.

41. Apparatus as specified in claim 38 wherein said means for sampling and comparing is for comparing said output to first and second threshold levels.

42. Apparatus as specified in claim 41 wherein said magnetic field detector has first output levels at said selected time when there is less than a desired number of plies of fabric between said source and said detector, a second output level at said selected time when there is a desired number of plies of fabric between said source and said detector, and third output levels at said selected time when there are more than a desired number of plies of fabric between said source and said detector, and wherein said first threshold level is between said first output levels and said second output level, and wherein said second threshold level is between said second output level and said third output levels.

43. Apparatus as specified in claim 42 wherein said desired number is one.

44. Apparatus as specified in claim 38 wherein said sampling and comparing means comprises an analog to digital converter responsive to said detector output and means for digitally comparing the output of said converter to said threshold level.

45. Apparatus as specified in claim 38 wherein said sampling and comparing means includes a programmed microprocessor.

46. Apparatus as specified in claim 38 wherein said magnetic field detector is mounted on a resilient support to firmly engage said transport mechanism when said transport mechanism moves said fabric between said source and said detector.

47. Apparatus as specified in claim 38 wherein said transport mechanism comprises a roller.

48. Apparatus for detecting the presence of fabric on a fabric transport mechanism having a fabric supporting surface, comprising a magnetic field detector mounted to form a part of said fabric supporting surface and a magnetic field source engaging said fabric on said supporting surface, said transport mechanism being arranged to transport fabric between said magnetic field source and said magnetic field detector, and means coupled to the operation of said transport mechanism for sampling the output of said magnetic field detector at a selected time during said operation, and for comparing said output to a threshold level, thereby to detect the presence of a fabric.

49. Apparatus as specified in claim 48 wherein said magnetic field detector has first output levels at said selected time when there is less than a desired number of plies of fabric between said source and said detector and a second output level at said selected time when there is a desired number of plies of fabric between said source and said detector, and wherein said threshold level is between said first and second output levels.

50. Apparatus as specified in claim 49 wherein said desired number of plies is one.

51. Apparatus as specified in claim 48 wherein said means for sampling and comparing is for comparing said output to first and second threshold levels.

52. Apparatus as specified in claim 51 wherein said magnetic field detector has first output levels at said selected time when there is less than a desired number of plies of fabric between said source and said detector, a second output level at said selected time when there is a desired number of plies of fabric between said source and said detector, and third output levels at said selected time when there are more than a desired number of plies of fabric between said source and said detector, and wherein said first threshold level is between said first output levels and said second output level, and wherein said second threshold level is between said second output level and said third output level.

53. Apparatus as specified in claim 52 wherein said desired number is one.

54. Apparatus as specified in claim 48 wherein said sampling and comparing means comprises an analog to digital converter responsive to said detector output and means for digitally comparing the output of said converter to said threshold level.

55. Apparatus as specified in claim 48 wherein said sampling and comparing means includes a programmed microprocessor.

56. Apparatus as specified in claim 48 wherein said magnetic field detector is mounted on a resilient support to firmly engage said transport mechanism when said transport mechanism moves said fabric between said source and said detector.

57. Apparatus as specified in claim 48 wherein said transport mechanism comprises a roller.

58. In a machine for operating on plies of fabric in a stack of fabric plies, wherein there is provided a fabric transport mechanism supported on a machine frame and engaging the top of said stack, apparatus for supporting said stack and for adjusting the position of said stack with respect to said transport mechanism comprising:

a support for said stack, mounted to said machine frame for vertical motion with respect to said transport mechanism;

means for urging said support in an upward direction with respect to said transport mechanism;

a controlled brake, arranged to prevent movement of said support with respect to said transport when engaged and to permit movement of said support when disengaged;

and control means operating in coordination with said transport mechnism for disengaging said brake when said transport mechanism engages the top of said stack and for engaging said brake when said transport mechanism is disengaged from said stack.

59. Apparatus as specified in claim 58 wherein said means for urging said support comprises a source of controlled fluid pressure, a cylinder having a piston operated on by said pressure, and means interconnecting said cylinder, said pistion, said support and said frame.

60. Apparatus as specified in claim 59 wherein said interconnecting means comprises lever means engaging said support and connected to one of said piston or said cylinder, and wherein the remaining one of said piston or said cylinder is connected to said frame.

61. Apparatus as specified in claim 59 wherein said brake is connected between said piston and said cylinder.

62. Apparatus as specified in claim 58 wherein said control means comprises a programmed microprocessor having a first output for controlling said transport mechanism and a second output for controlling said brake.

63. Apparatus as specified in claim 58 wherein said transport mechanism comprises a roller.

64. Apparatus for separting alternate plies from a first stack of fabric plies into second and third separate stacks, comprising:

a frame;

a first support mounted to said frame and having a first horizontal support platform for holding said first stack of fabric plies;

a second support mounted to said frame and having second and third vertically-separated, horizontal support platforms for holding said second and third stacks of fabric, said second support being arranged for vertical movement with respect to said frame;

a carriage mounted on said frame for horizontal motion between positions corresponding to said first and second supports;

a roller having an axis and carried by said carriage and arranged for rotation with respect thereto in response to motion of said carriage at an angular rotation speed corresponding to approximately zero horizontal motion of the bottom sector of said roller;

engagement means carried by said roller for engaging a top ply of fabric from said first stack;

first transport means for periodically moving said carriage horizontally back and forth across said frame;

second transport means for moving said second support between a first vertical position, wherein said carriage and said roller passes over said second support platform, and a second vertical position, wherein said carriage and said roller passes over said third support platform;

and control means for coordinating the operation of said first transport means, said second transport means and said engagement means to cause said engagement means to engage a first ply from said first stack, transport said first ply on said roller and disengage said first ply on said second stack, with said second support in said first position and to engage a second ply from said first stack, transport said second ply on said roller and disengage said second ply on said third stack, with said second support in said second position.

65. Apparatus as specified in claim 64 wherein said first support is arranged for vertical motion with respect to said frame, and wherein there are provided first adjusting means for adjusting the level of said first platform with respect to said roller.

66. Apparatus as specified in claim 65 wherein said first adjustment means comprises means for urging said first platform in an upward vertical direction, and a brake for preventing upward vertical movement of said first platform, said brake being engaged when said roller is in a position not engaging said first stack.

67. Apparatus as specified in claim 65 wherein there are provided second adjusting means for adjusting the level of said second and third platforms with respect to said roller.

68. Apparatus as specified in claim 67 wherein said second adjustment means comprises means for independently adjusting the level of said second and third platforms.

69. Apparatus as specified in claim 68 wherein said second adjusting means comprises first and second means respectively urging each of said second and third platforms in an upward vertical direction, and first and second independently activated brakes, each for preventing vertical movement of said second and third platforms, at respective times when said roller is not engaging said second and third stacks.

70. Apparatus as specified in claim 67 wherein said second adjustment means comprises means for adjusting the level of said second support.

71. Apparatus as specified in claim 67 wherein said second adjusting means comprises means urging said second support in an upward vertical direction, and a brake preventing vertical movement of said second support when said roller is not engaging said second or third stack.

72. Apparatus as specified in claim 64 wherein there is provided a cable frictionally engaging said roller and having ends connected to said frame, whereby said cable causes said angular rotation of said roller in response to movement of said first transport means.

73. Apparatus as specified in claim 64 wherein said engagement means comprises an elongated rod mounted on said roller in a longitudinal opening on the outer periphery of said roller, said elongated rod having pins projecting therefrom, and said rod being pivotable about a longitudinal axis to rotate said pins from a first orientation wherein said pins are orientated radially with respect to said roller axis to a second orientation wherein said pins are oriented circumferentially with respect to said roller axis.

74. Apparatus as specified in claim 73 wherein said pins extend from said rod by a distance which is less than the thickness of said fabric plies.

75. Apparatus as specified in claim 73 wherein said pins extend from said rod by a distance which ranges from approximately one-half the thickness of said fabric plies to less than the thickness of said fabric plies.

76. Apparatus as specified in claim 73 wherein said rod is pivotable by an operating means from said first to said second orientation, and wherein said operating means comprises a fluid operated piston, carried by said roller, and wherein fluid is supplied to said piston by a flexible conduit which wraps around the periphery of said roller.

77. Apparatus as specified in claim 73 wherein said rod is further provided with openings, and wherein there are provided means for emitting gas from said openings.

78. Apparatus as specified in claim 77 wherein said means for emitting gas includes a flexible gas conduit connected to said openings and which wraps around the periphery of said roller.

79. Apparatus as specified in claim 64 wherein said control means comprises a programmed microprocessor.

80. Apparatus as specified in claim 79 wherein said first transport means comprises a stepper motor responsive to pulses supplied by said microprocessor.

81. Apparatus as specified in claim 79 wherein said engagement means includes an elongated rod mounted in a longitudinal opening of said roller and arranged for rotation about a longitudinal axis with respect to said roller and operating means for pivoting said rod between first and second orientations about said axis and wherein said microprocessor provides signals, coordinated with the operation of said roller, for activating said operating means.

82. Apparatus as specified in claim 81 wherein said rod is provided with openings, and wherein there are provided means for emitting gas through said openings, and whrein said microprocessor provides control signals for controlling the operation of said gas emitting means.

83. Apparatus as specified in claim 79 wherein there is provided means responsive to the position of said carriage, for providing a signal to said microprocessor when said carriage is in a reference position.

84. Apparatus as specified in claim 64 wherein said signaling means comprises a magnet and a magnetic field detector one of which is mounted to said frame and the other of which is mounted to said carriage.

85. Apparatus as specified in claim 64 wherein said roller has a circumference which is greater than the length of said fabric plies in the direction of travel of said carriage.

86. Apparatus as specified in claim 85 wherein the distance between corresponding portions of said first support platform and said second and third support platforms in a horizontal direction corresponds to an integral number of circumferences of said roller.

87. Apparatus as specified in claim 86 wherein said integral number is one.

88. Apparatus as specified in claim 64 wherein the axial length of said roller exceeds the width of said plies in the direction of said roller axis.

89. Apparatus as specified in claim 64 wherein said first support platform further includes a foam pad on said platform, supporting at least a portion of said first stack in the vicinity of engagement of said stack by said engagement means.

90. Apparatus as specified in claim 64 wherein said second and third support platforms each include a foam pad on said platforms in the vicinity of said platforms engaged by said engagement means, for supporting at least a portion of each of said second and third stacks.

91. Apparatus as specified in claim 64 wherein there is further provided means for detecting the presence of a fabric ply on said roller.

92. Apparatus as specified in claim 91 wherein said detecting means includes a magnet and a magnetic field sensor, and wherein said control means samples the output of said magnetic field detector during a time period of said carriage motion corresponding to the transport of a fabric ply by said roller past said sensor.

* * * * *

UNITED STATES PATENT AND TRADEMARK OFFICE

CERTIFICATE OF CORRECTION

PATENT NO. : 4,555,102

DATED : November 26, 1985

INVENTOR(S) : Elbert Engle

It is certified that error appears in the above-identified patent and that said Letters Patent is hereby corrected as shown below:

Column 1, line 53, "from" should read --for--;
Column 2, line 17, "extends" should read --extend--;
Column 2, line 20, "extends" should read --extend--;
Column 2, line 23, after "through" delete "when";
Column 3, line 67, "a" should read --and--;
Column 4, lines 25-26, "mechansim" should read --mechanism--;
Column 4, line 46, "respectfully" should read --respectively--;
Column 6, line 6, "plaftorm" should read --platform-- and "pistion" should read --piston--;
Column 8, line 3, "flatened" should read --flattened--;
Column 8, line 32, "magentic" should read --magnetic--;
Column 9, line 42, "direcion" should read --direction--;
Column 10, line 55, "operates" should read --operate--;
Column 11, lines 10-11, "provides" should read --provide--;
Column 11, line 49, "recognized" should read --recognize--;
Column 11, line 67, before "said axis" insert --about--; and
Column 17, line 16, "separting" should read --separating--.

Signed and Sealed this

Twenty-ninth Day of July 1986

[SEAL]

Attest:

DONALD J. QUIGG

Attesting Officer

Commissioner of Patents and Trademarks